US006061829A

United States Patent [19]

Gunn

[11] Patent Number: 6,061,829

[45] Date of Patent: May 16, 2000

[54] LOW FRICTION OUTER APPAREL

[75] Inventor: Robert T. Gunn, 360 E. 65th St., Apartment 11E, New York, N.Y. 10021

[73] Assignee: Robert T. Gunn, NYC, N.Y.

[ * ] Notice: This patent is subject to a terminal disclaimer.

[21] Appl. No.: 08/968,008

[22] Filed: Nov. 12, 1997

Related U.S. Application Data

[63] Continuation of application No. 08/389,759, Feb. 14, 1995, which is a continuation-in-part of application No. 08/217,490, Mar. 24, 1994, Pat. No. 5,590,420.

[51] Int. Cl.[7] ..... A41B 1/00

[52] U.S. Cl. ..... 2/69; 2/158

[58] Field of Search ..... 2/239, 69, 243.1, 2/904, 902, 168, 158, 161.7, 161.1, 167, 46, 48, 51, 50, 81, 83, 114, 22, 16, 455, 456, 23, 24; 36/138, 43, 44, 35, 72 R

[56] References Cited

U.S. PATENT DOCUMENTS

| | | | |
|---|---|---|---|
| 4,261,061 | 4/1981 | McAlvage | 2/239 |
| 4,494,247 | 1/1985 | Kelly | 2/24 |
| 5,154,682 | 10/1992 | Kellerman | 36/44 |
| 5,323,815 | 6/1994 | Barbeau et al. | 2/69 X |
| 5,575,012 | 11/1996 | Fox et al. | 2/239 |
| 5,590,420 | 1/1997 | Gunn | 2/69 |

FOREIGN PATENT DOCUMENTS

| | | |
|---|---|---|
| 63-051857 | 3/1988 | Japan . |
| 5339879 | 12/1993 | Japan . |

*Primary Examiner*—Gloria M. Hale
*Attorney, Agent, or Firm*—Frommer Lawrence & Haug LLP

[57] ABSTRACT

The present invention relates to apparel, such as clothing, footwear, fabrics, and the like, which incorporates fabrics or chemicals having a low coefficient of friction either overall or in specific areas of the apparel that will minimize the development of blisters, callouses, and irritation of the skin. The present invention also relates to apparel which incorporates fabrics or chemicals having a low coefficient of friction either overall or in specific areas of the outer surface of the apparel that will minimize frictional contact with external objects. The invention also includes methods for producing this low friction apparel and apparel with a low friction outer surface.

50 Claims, 7 Drawing Sheets

11
10

LOW FRICTION OUTER APPAREL

This application is a continuation of U.S. patent application Ser. No. 08/389,759 filed Feb. 14, 1995, which is a continuation-in-part of U.S. patent application Ser. No. 08/217,490 filed Mar. 24, 1994 (now U.S. Pat. No. 5,590, 420), both of which applications are incorporated herein by reference.

BACKGROUND OF INVENTION

This invention relates to low friction apparel and methods for producing same, wherein apparel is defined as clothing, footwear, fabrics, and the like. More particularly, the invention relates to low friction apparel which incorporates fabrics or chemicals having a low coefficient of friction either overall or in specific areas of the apparel that will minimize the development of blisters, callouses, and irritation of an apparel wearer's body surface. The invention also includes methods for producing the low friction apparel and methods for using a low friction material to reduce the coefficient of friction of a finished article of apparel or the like to reduce irritation.

This invention further relates to apparel with a low friction outer surface and methods for producing same. More particularly, the invention relates to apparel with a low friction outer surface which incorporates fabrics or chemicals having a low coefficient of friction either overall or in specific areas of the outer surface of the apparel, such that a low friction surface will presented on the exterior surface of the apparel. The invention also includes methods for producing the apparel with a low friction outer surface and methods for using a low friction material to reduce the coefficient of friction of the exterior of a finished article of apparel or the like.

Apparel is made out of many materials, natural and man-made. They include cotton, wool, silk, linen, leather, vinyl, nylon-polyamides and polyamide co-polymers, LYCRA SPANDEX™ in different filament configurations, orlon polyvinylidene fluoride, such as KYNAR™, polyester, for example, polyethylene terepthalate, glycol modified polyesters, such as PETG, KODURA™, rayon, orlon cellulosic fiber blends, and the like, as well as blends of the above.

Of course, apparel, either directly or indirectly, contacts the body surface of the wearer. The movement of the wearer causes frictional contact between the wearer's body surface and the apparel. This frictional contact can cause irritation, blisters, and callouses. This frictional contact is particularly a problem in sporting apparel wherein the formation of irritations, blisters, and callouses is exacerbated by the rapid and/or repetitious body movements related to the particular activity. Additionally, it is noted that most apparel has specific areas of high body surface/apparel contact which produces a majority of the irritations, blisters, and callouses.

Furthermore, the outer surface of apparel contacts external objects and surfaces such as walls, floors, furniture, and other pieces of apparel (worn by others or by the wearer). The movement of the wearer causes frictional contact between the wearer's apparel and the external objects and surfaces. This frictional contact can be, at times, be very undesirable. In general, frictional contact of any object with air, water, or solid surfaces slows or brings a moving object to a stop (or, in the case of a falling object, to terminal velocity). This frictional contact is particularly a problem in sports where a participant's bodily momentum is brought to an abrupt or sliding halt. If the bodily momentum could be dissipated such as in a sliding motion, injuries which occur in these sports could be minimized.

Another situation where frictional contact can be very undesirable, is in body contact sports. In sports which require a player to grip or tackle an opposing player, it would be advantageous to the opposing player to wear apparel which is difficult to grip. Additionally, in sports where players (either opposing players or team members) make bodily contact, it would be advantageous to minimize the effect of pushing and jostling of contact (i.e. bumping, pushing, etc.) during play.

Another situation where frictional contact can be very undesirable, is in high speed sports and sports where the difference between winning and losing is determined in fractions of a second. In these sports, any speed or momentum lost to friction can mean the difference between winning and losing.

It would be highly desirable to have apparel which has an overall low coefficient of friction or which has material having a low coefficient of friction in areas of high body surface/apparel contact such that irritations, blisters, and callouses are avoided or minimized.

It would also be highly desirable to have apparel which has an overall low coefficient of friction or which has material having a low coefficient of friction in areas of high apparel outer surface/external object contact such that frictional contact is minimized.

SUMMARY OF TE INVENTION

It is a principle object of the invention to provide low friction apparel which avoids or minimizes the development of irritations, blisters, and callouses.

A further object of the invention is to provide a method for producing low friction apparel by chemically treating the fibers or yarn or the like of the material from which the apparel is made prior to or after producing the material.

Another object of the invention is to provide a method for producing low friction apparel by incorporating low friction yarns, fibers or material into the fabric from which the apparel is made.

Still another object of the invention is to provide a method for producing low friction apparel by applying chemicals to impart a low friction coefficient directly to the fabric or apparel either overall or in areas of high body surface/apparel contact.

It is yet another principle object of the invention to provide apparel which has a low friction outer surface.

Still a further object of the invention is to provide a method for producing apparel with a low friction outer surface by chemically treating the fibers or yarn or the like of the material from which the apparel is made prior to or after producing the material.

Another object of the invention is to provide a method for producing apparel with a low friction outer surface by incorporating low friction yarns, fibers or material into the fabric from which the apparel is made.

Yet another object of the invention is to provide a method for producing apparel with a low friction outer surface by applying chemicals to impart a low friction coefficient directly to the fabric or apparel either overall or in areas of high apparel outer surface/external object contact.

BRIEF DESCRIPTION OF THE DRAWINGS

The following detailed description, given by way of example and not intended to limit the present invention solely thereto, will best be appreciated in conjunction with the accompanying drawings, in which.

DETAILED DESCRIPTION OF THE INVENTION

Figure 1:
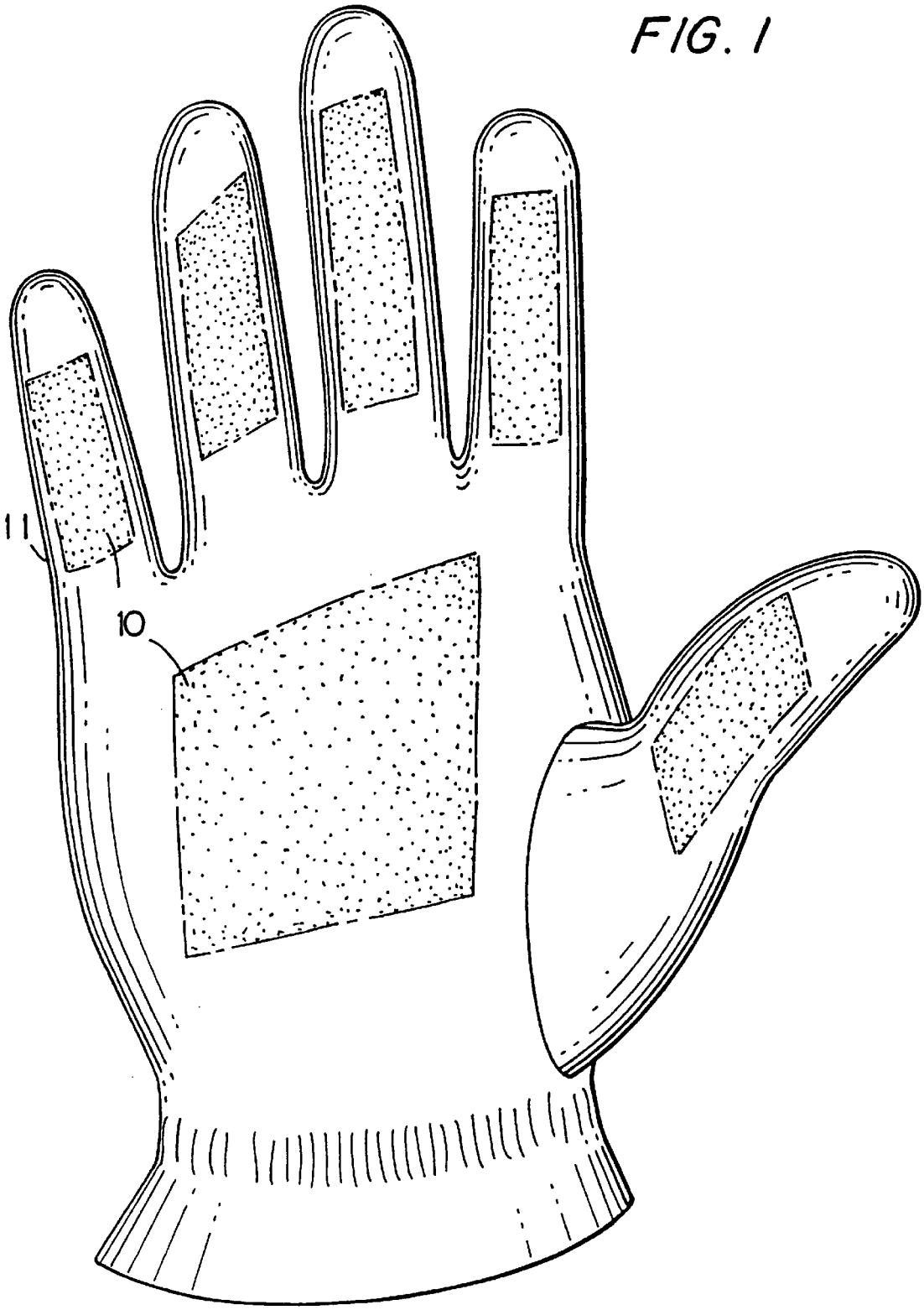
FIG. 1 is a front elevation view of a glove of the invention.

As indicated above, the present invention provides low friction apparel to avoid or minimize irritations, blisters, and callouses that can result from abrasive contact between a wearer's body surface and the apparel. Low friction apparel can be made with low friction materials (10, FIGS. 1–12B). These low friction materials can be fibers which inherently have a low coefficient of friction which are incorporated into the material either alone or in combination with other materials; low friction chemicals which can be applied directly to the finished fibers, material, or apparel to impart low friction properties; fibers which are treated with low friction chemicals then woven into the material either alone or in combination with other material; or any combination of the above. These low friction materials (10, FIGS. 1–12B) can be incorporated into the entire piece of apparel or in specific high body surface/apparel contact areas.

Some material fibers inherently have a low coefficient of friction. These fibers include, but are not limited to, silicone, graphite, TEFLON™, KYNAR™, boron, polypropylene, polyethylene, and GORTEX™. These materials can be incorporated directly into the apparel either overall or in specific high body surface/appeal contact areas to produce low friction apparel.

Chemicals can be used to treat material fibers or finished materials that do not inherently have a low coefficient of friction in order to impart a low coefficient of friction. Additionally, this chemical treatment can be used with materials which do inherently have a low coefficient of friction in order to impart an even lower coefficient of friction. This chemical treatment is incorporated into the material such that it is of a non-temporary nature. Most preferably, this chemical treatment is incorporated into the material such that it is functional substantially over the lifetime of the treated article. These chemicals include, but are not limited to, silicone, silicone co-polymers, silicone elastomers, polytetrafluoroethylene, homopolymers and copolymers such as TEFLON™, graphite, and the like, as well as any combination of the above chemicals. The fibers can be treated with these chemicals by coextrusion when producing the fibers, blending with the fibers after production, adding in a bath form or spraying onto the fiber or material, or similar techniques. The finished material can be treated with these chemicals by adding in a bath form or spraying onto the material, or similar techniques.

In a typical application of the invention, a fiber, yarn or fabric or finished article (such as apparel) is treated with the low coefficient of friction material to reduce the coefficient of friction of the treated fiber, yarn, fabric or article to one which is below the coefficient of friction of the untreated fiber, yarn, fabric or finished article.

It is preferred that the coefficient of friction of the treated object be less than about 80%, preferably less than about 60% and most preferably less than about 50% of the coefficient of friction of the untreated object.

If the low friction material is incorporated into the finished article or fabric by weaving a low friction fiber or yarn into the article or fabric, the low friction fiber or yarn can be incorporated into amounts ranging from 5% to 95% by weight of the treated area. Preferably, the fiber or yarn is incorporated in amounts between 30 and 70% by weight of the treated area. Most preferably, these amounts are 30 to 50%, by weight.

It is of course understood that when finished material is treated with chemicals to impart a low coefficient of friction, in particular when spraying onto the material, the amount incorporated into the finished material can be as small as a fraction of a percent by weight of the treated area.

The addition of the low friction material to the fiber, yarn, fabric or article can also be useful to wick away moisture from the skin to help guard against irritation, as well as wetness.

It is preferred that areas of objects treated are typically areas which would ordinarily come in contact with the skin during use. Furthermore, it would be preferred that areas treated be those areas subject to imparting frictional movement against the skin during use.

It is preferred also that the coefficient of friction between the treated area of the object and the body surface to be reduced to below about 0.9. Most preferably, the coefficient of friction is reduced to below about 0.6.

The following examples are set forth to illustrate specific embodiments of the invention for low friction apparel.

EXAMPLE 1

Figure 3:
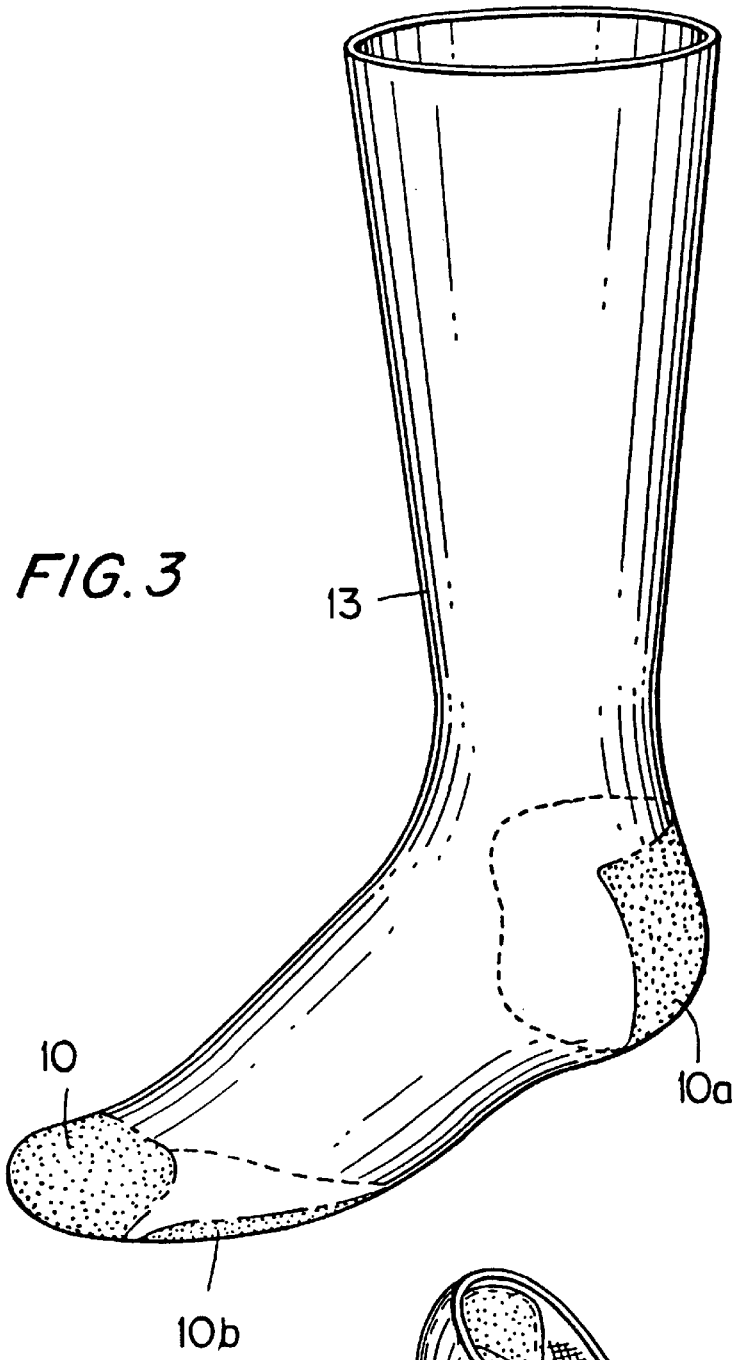
FIG. 3 is a perspective view of a sock or hosiery of the invention.

In one embodiment, low friction socks as shown in FIG. 3 or hosiery can be produced by incorporating low friction material overall or in specific high contact areas such as in the heel area 10*a* (FIG. 3), the area around the pad of the sole of the foot 10*b* (FIG. 3), the area extending from the pad of the foot to the right and left sides of the foot, in the region where the foot is the widest, and the area around the toes 10 (FIG. 3). Areas of the foot which contact laces, buckles or straps are also contact areas where protection would be utilized. The low friction material can also be incorporated to the outside of the sock which reduces friction between the sock and the outer foot apparel, such as a shoe. The low friction material can be incorporated to the inside of the sock which reduces friction between the wearer's foot and the sock. Additionally, low friction material can be incorporated to both inside and outside of the sock which, of course, simultaneously reduces friction between the sock and the outer footwear, and the wearer's foot and the sock.

EXAMPLE 2

In another embodiment, outer footwear such as a shoe, sneaker, boot, ski boot, sandal, slipper and the like, can have low friction material incorporated into the outer footwear fabric lining at high body surface/apparel contact areas thereby reducing friction between the wearer's foot or sock and the footwear. It is also noted that in footwear which has no fabric lining, the footwear material itself, such as leather, can be treated with low friction coefficient chemicals in high body surface/apparel contact areas 10, 21 (FIG. 9) to have a similar result.

Figure 9:
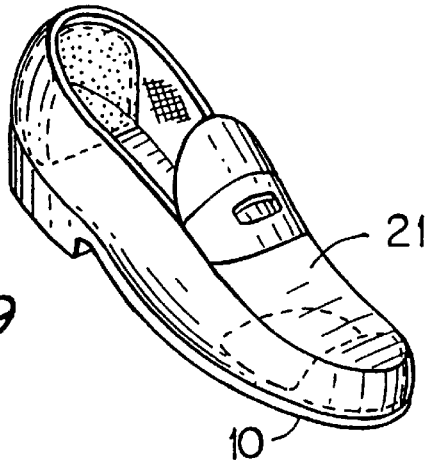
FIG. 9 is a perspective view of a footwear of the invention.

The low friction material is particularly useful in areas where the product would rub against the skin and cause irritation, blisters or callouses. In feet, these areas would be the heel, sole, the pads of the feet at the wide portion of the foot as shown in FIG. 9 or the top of the foot which contacts laces, buckles or straps.

EXAMPLE 3

Figure 8:
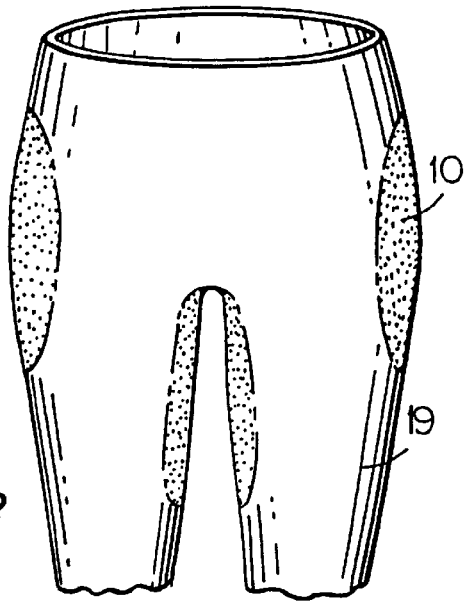
FIG. 8 is a perspective view of an athletic wear of the invention.

In a further embodiment, sporting apparel, such as warm-up pants, shorts, jogging suits, bicycle pants, wet suits, work pants and the like, can have low friction material 10 (FIG. 8) incorporated into high body surface/apparel contact areas such as the groin area and along the seams, such as the inner thigh seam, to avoid rubbing and irritations as shown in FIG. 8. Additionally, sporting apparel, such as sport shirts, warm-up shirt, and the like, can have low friction material incorporated into high body surface/apparel contact areas such as the neck and underarm areas to also avoid rubbing and irritations.

EXAMPLE 4

Figure 2:
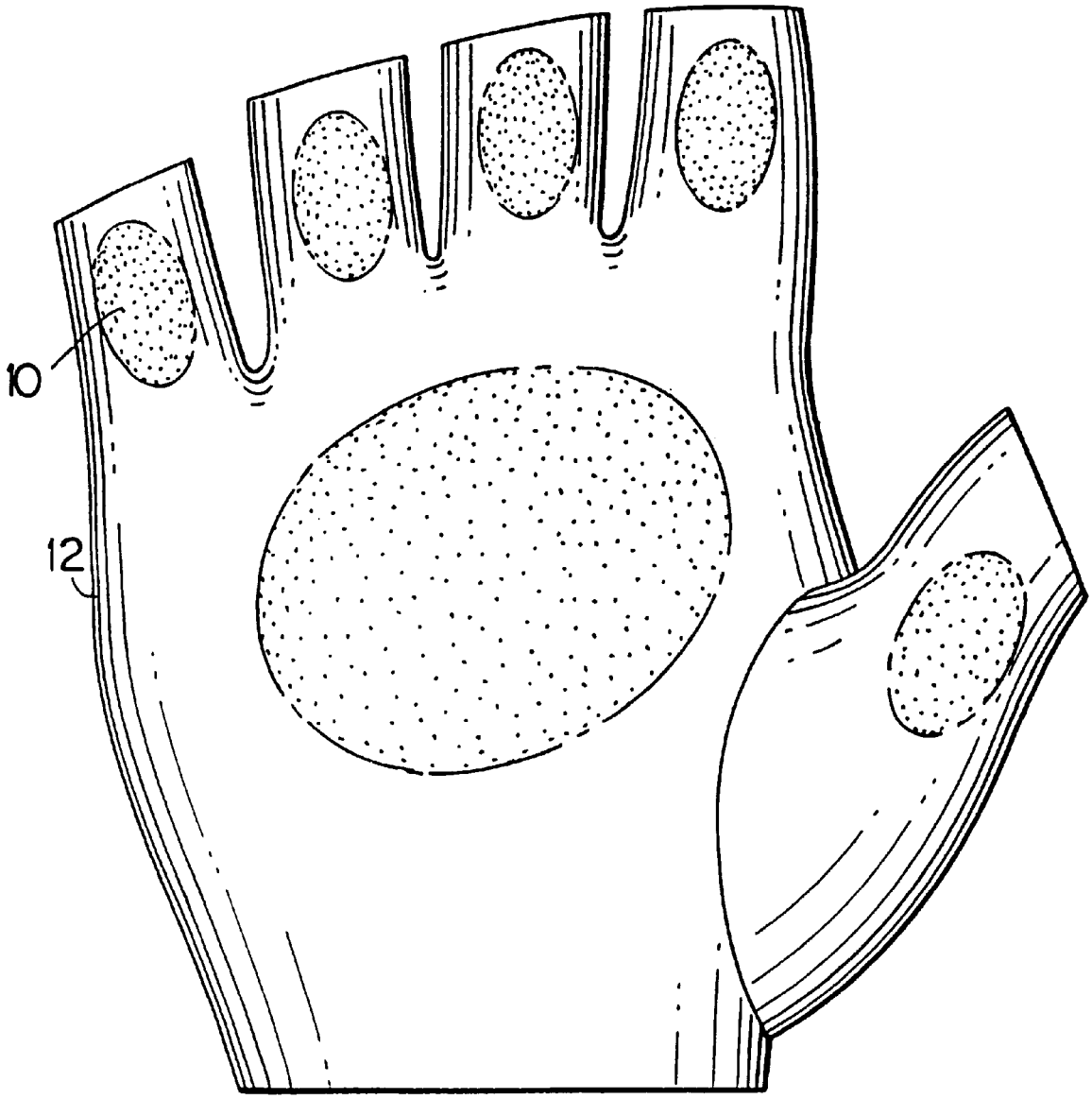
FIG. 2 is a front view of an alternative embodiment of the glove of the invention.

In yet another embodiment, work and sport gloves as shown in FIGS. 1–2, such as gloves used with tools, golf clubs, baseball bats, polo mallets, and tennis, squash and racquetball racquets, can have low friction material incorporated the glove 10, 11 (FIG. 1) and 10, 12 (FIG. 2) at high body surface/apparel contact areas to avoid blisters and callouses on the hands.

EXAMPLE 5

Figure 4:
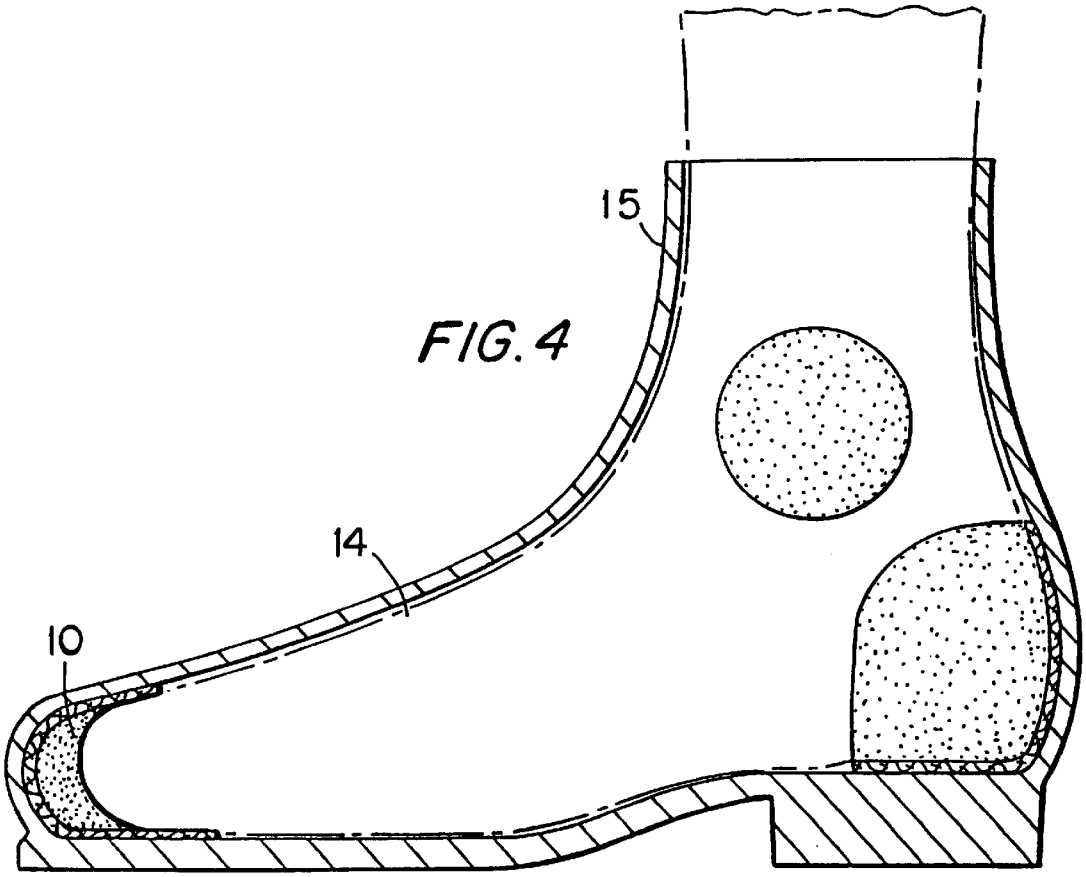
FIG. 4 is a cross sectional view of a foot insert of the invention.
Figure 4A:
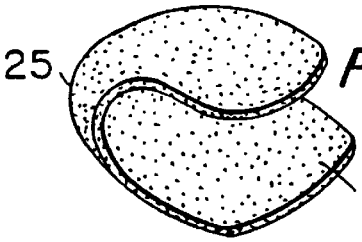
FIG. 4A is a perspective view of a toe insert of the invention.
Figure 4B:
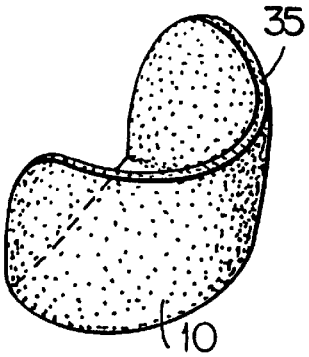
FIG. 4B is a perspective view of a heel cup insert of the invention.
Figure 4C:
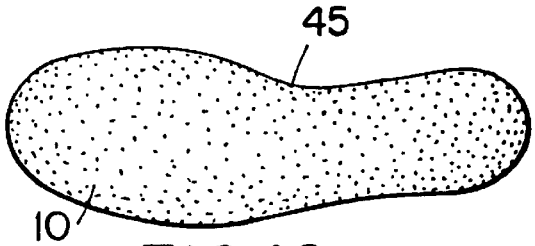
FIG. 4C is a bottom plan view of a shoe insert of the invention.
Figure 4D:
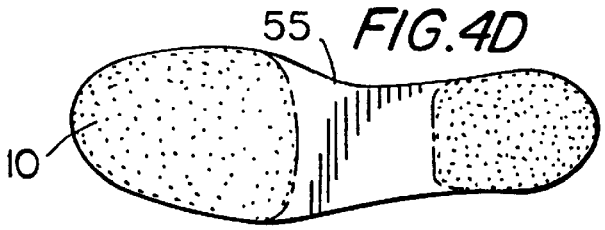
FIG. 4D is a bottom plan view of an alternative shoe insert of the invention.

The low friction material can be utilized in footwear inserts 10, 14, 15 (FIG. 4); 10, 25 (FIG. 4A); 10, 35 (FIG. 4B); 10, 45 (FIG. 4C); and 10, 55 (FIG. 4D) and other devices as shown in FIG. 4, made to fit in traditional footwear that will help avoid blisters and callouses by reducing friction of the foot against the pressure areas of footwear such as heel cushions 10, 35 (FIG. 4B), insoles 10, 45 (FIG. 4C) and 10, 55 (FIG. 4D), orthotics, cushions and other pads (bandages).

EXAMPLE 6

Figure 5:
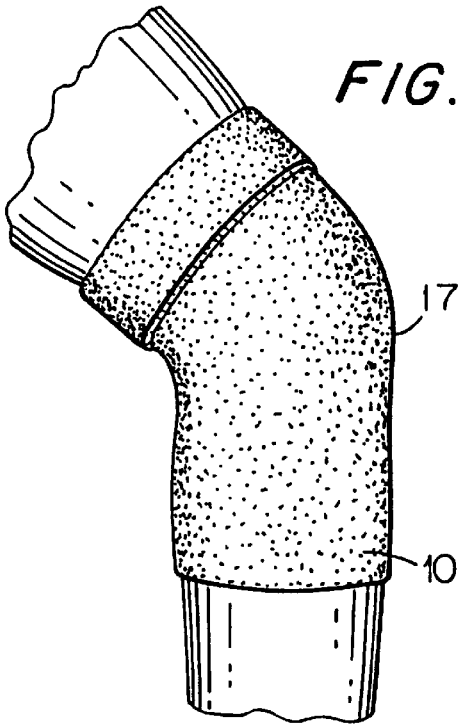
FIG. 5 is a perspective view of a knee bandage of the invention.
Figure 6:
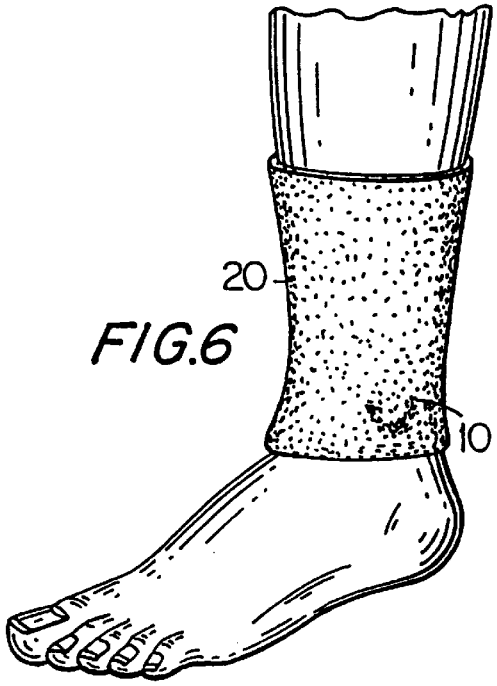
FIG. 6 is a perspective view of an ankle bandage of the invention.
Figure 7:
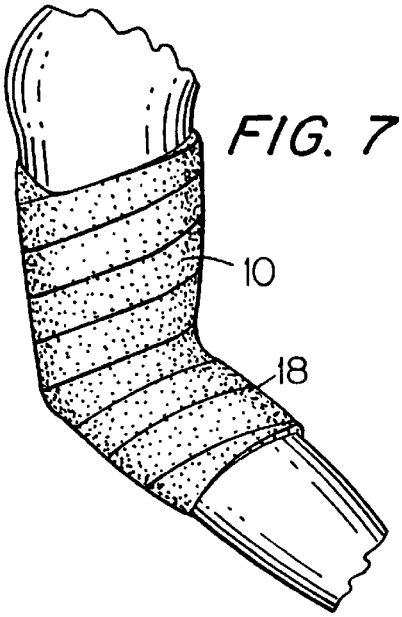
FIG. 7 is a perspective view of an elbow bandage of the invention.

The low friction material can also be used in bandages and wraps as shown in FIGS. 5–7, which support torn and sore muscles, ligaments and joints and as linings for casts 10, 17 (FIG. 5); 10, 20 (FIG. 6) and 10, 18 (FIG. 7).

EXAMPLE 7

The low friction material can be incorporated into covers for sporting equipment and tools and other devices that one uses that could cause irritation, blisters, callouses or soreness from friction.

Handles of baseball bats, handles of tennis and racquetball racquets, shovels, picks, construction and garden tools, hammers, screwdrivers, pliers, etc, handles of ski poles, fishing rods, water ski rope grips and towing ropes, golf clubs, archery bows, bicycle seats, car seats and back seats, weights and exercise equipment, etc., are all areas which can be incorporated with the low friction material.

It is understood that the invention is not limited to human apparel. The invention can also be used in horse blankets, pet apparel and the like.

Also as indicated above, the present invention provides apparel with a low friction outer surface to minimize the fictional effect of apparel outer surface/external object contact. Apparel with a low friction outer surface can be made with a low friction materials 10 (FIGS. 1–12B). These low friction materials can be fibers which inherently have a low coefficient of friction which are incorporated into the material either alone or in combination with other materials; low friction chemicals which can be applied directly to the finished fibers, material, or apparel to impart low friction properties; fibers which are treated with a low friction chemicals then woven into the material either alone or in combination with other material; or any combination of the above. These low friction materials can be incorporated into the entire exterior surface of the apparel or in specific high apparel surface/external object or surface contact.

The above mentioned low coefficient of friction materials can be incorporated directly into the apparel either overall or in specific high apparel surface/external object or surface contact areas to produce apparel with a low friction outer surface.

The chemicals treatment techniques discussed above also apply to producing low friction outer surface apparel.

In a typical application of the invention, a fiber, yarn or fabric or finished article (such as apparel) is treated with the low coefficient of friction material to reduce the coefficient of friction of the treated fiber, yarn, fabric or article to one which is below the coefficient of friction of the untreated fiber, yarn, fabric or finished article.

It is preferred that the coefficient of friction of the treated object be less than about 80%, preferably less than about 60% and most preferably less than about 50% of the coefficient of friction of the untreated object.

If the low friction material is incorporated into the finished article or fabric by weaving a low friction fiber or yarn into the article or fabric, the low friction fiber or yarn can be incorporated into amounts ranging from 5% to 95% by weight of the treated area. Preferably, the fiber or yarn is incorporated in amounts between 30 and 70% by weight of the treated area. Most preferably, these amounts are 30 to 50%, by weight.

It is of course understood that when finished material is treated with chemicals to impart a low coefficient of friction, in particular when spraying onto the material, the amount incorporated into the finished material can be as small as a fraction of a percent by weight of the treated area.

The addition of the low friction material to the fiber, yarn, fabric or article can also be useful to wick away moisture from the skin to help guard against irritation, as well as wetness.

It is of course understood that apparel can be produced with both low friction body surface/apparel areas which avoids or minimizes the development of irritations, blisters, and callouses and low friction outer surface/external object contact such that frictional contact is minimized.

It is preferred that areas of apparel treatment are typically areas which would ordinarily come in contact with the external contact surface during use.

It is preferred also that the coefficient of friction between the treated area of the apparel and the external contact surface to be reduced to below about 0.9. Most preferably, the coefficient of friction is reduced to below about 0.6.

The following examples are set forth to illustrate specific embodiments of the apparel with a low friction outer surface.

EXAMPLE 8

Figure 10A:
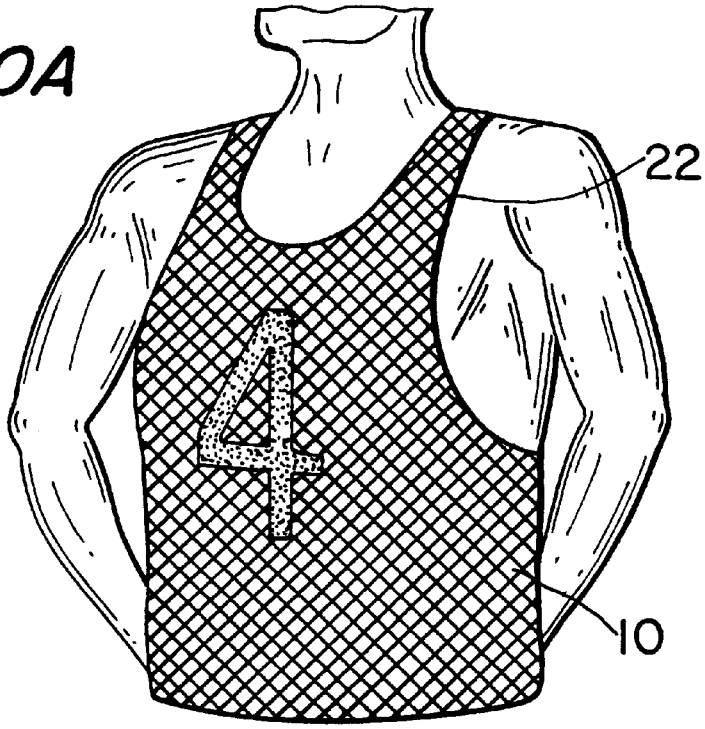
FIG. 10A is a front view of a sports uniform of the invention.
Figure 10B:
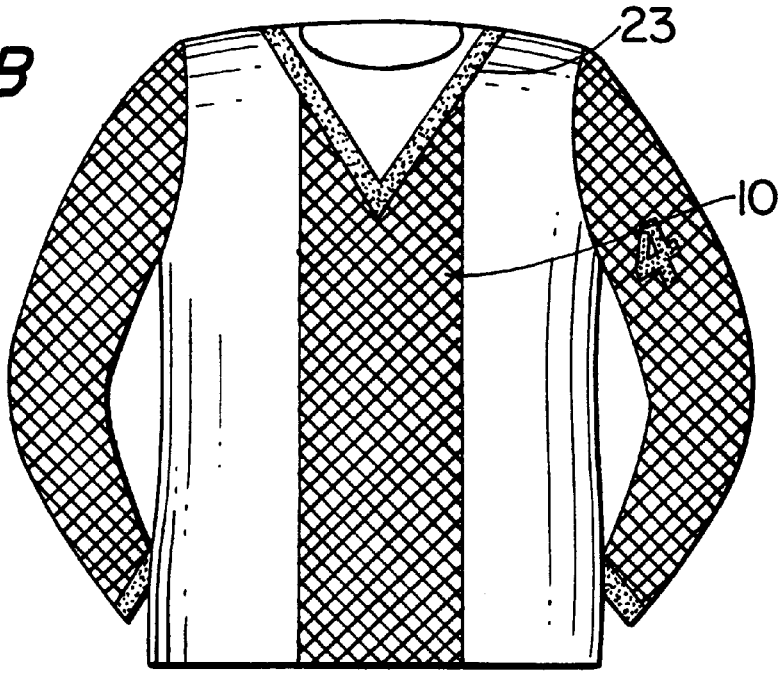
FIG. 10B is a front view of an alternative embodiment of the sports uniform of the invention.
Figure 11:
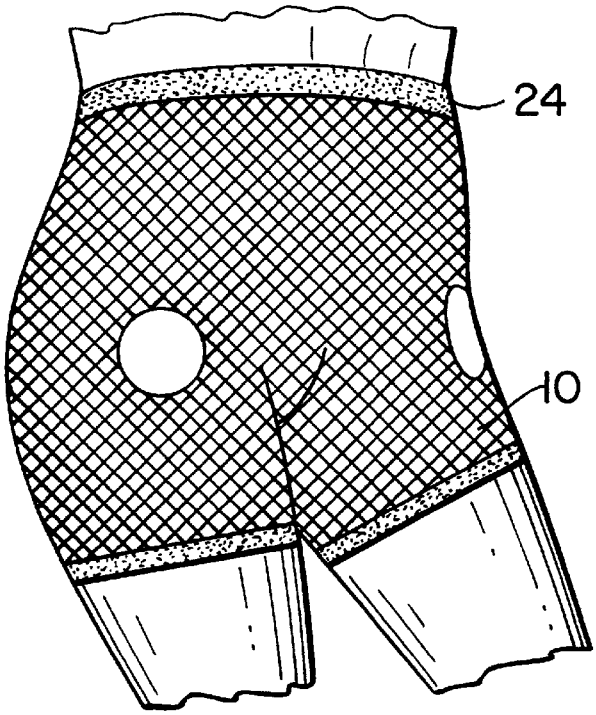
FIG. 11 is a perspective view of sports protection apparel of the invention.
Figure 12A:
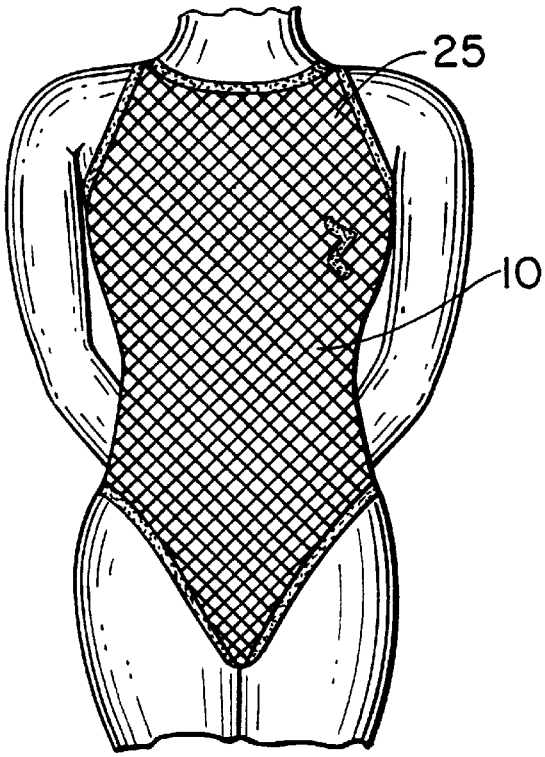
FIG. 12A is a front view of a water apparel of the invention.
Figure 12B:
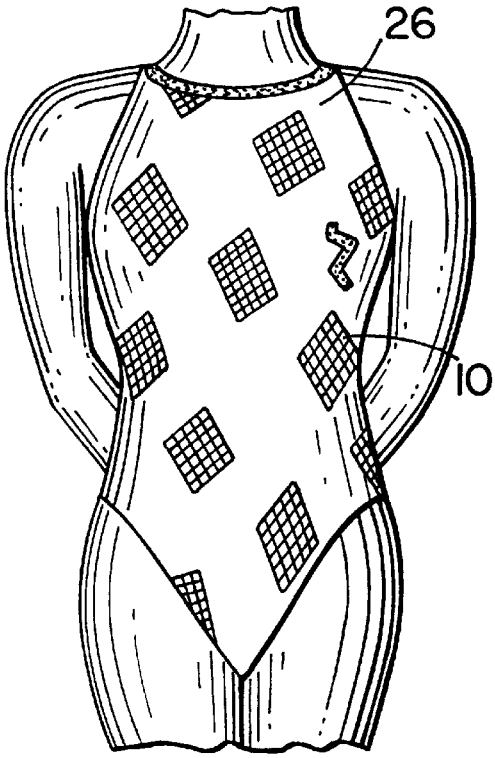
FIG. 12B is a front view of an alternative embodiment of the water apparel of the invention.

In one embodiment, sporting apparel, such as uniforms used in football, wrestling, and rugby where an opponent tackled or gripped during play, can have low friction material incorporated directly into the apparel either overall as shown in FIG. 10A, or in specific surface contact areas as shown in FIG. 10B, to produce apparel with a low friction outer surface which is difficult to grip to make it hard to tackle or handle the opponent.

Additionally, sporting apparel, such as uniforms used in football, baseball, basketball, wrestling, racquetball, squash, rugby, soccer, lacrosse, hockey, field hockey, and handball, where players (either opposing players or team members) make bodily contact, can have low friction material incorporated directly into the apparel either overall 10, 22 (FIG. 10A) or in specific surface contact areas 10, 23 (FIG. 10B) to produce apparel with a low friction outer surface to minimize the effect of pushing and jostling of contact during play.

EXAMPLE 9

In another embodiment, sports protection apparel, such as knee pads, elbow pads, and hand protection used in volleyball, basketball, skating (particularly in-line skating), skateboarding, and soccer, can have low friction material incorporated directly into the protection apparel either overall 10, 24 (FIG. 11) or in specific surface contact areas to reduce injuries which occur in these sports.

In general, frictional contact of any object with air, water, or solid surfaces slows or brings a moving object to a stop. This frictional contact is particularly a problem in sports where a participant's bodily momentum is brought to an abrupt or sliding halt. If the bodily momentum is dissipated by a sliding motion which would occur from the incorporation of low friction material, injuries which occur in these sports could be minimized.

EXAMPLE 10

In a further embodiment, sporting apparel, such as used in sports where friction is very undesirable. In high speed sports and sports where the difference between winning and losing is determined in fractions of a second such as swimming, running, and downhill or ultimate downhill skiing, low friction material can be incorporated directly into the apparel either overall 10, 25 (FIG. 12A) or in specific surface contact areas 10, 26 (FIG. 12B) to produce apparel with a low friction outer surface to minimize frictional contact with air or water.

Additionally, low friction material can be incorporated into water apparel such as wet suits to minimize frictional contact with water.

It is also understood that the invention is not restricted to the detailed description of the invention, which may be modified without departure from the accompanying claims.

What is claimed is:

1. An article of clothing having incorporated therein a non-temporary low coefficient of friction material that imparts a low coefficient of friction characteristic to the outer surface of the article so that frictional contact between the outer surface of the article and an external environment is reduced, said low coefficient of friction material being incorporated into the article of clothing by weaving and/or knitting into the article of clothing fibers having a low coefficient of friction characteristic.

2. The article of clothing of claim 1, wherein the coefficient of friction of the outer surface of the article incorporating the low coefficient of friction material is less than about 80% of the coefficient of friction of the outer surface of the article not incorporating the low coefficient of friction material.

3. The article of clothing of claim 1, wherein the coefficient of friction of the outer surface of the article incorporating the low coefficient of friction material is less than about 60% of the coefficient of friction of the outer surface of the article not incorporating the low coefficient of friction material.

4. The article of clothing of claim 1, wherein the coefficient of friction of the outer surface of the article incorporating the low coefficient of friction material is less than about 50% of the coefficient of friction of the outer surface of the article not incorporating the low coefficient of friction material.

5. The article of clothing of claim 1, wherein the low coefficient of friction material includes silicone, silicone copolymers, silicone elastomers, polytetrafluoroethylene or homopolymers and copolymers thereof, graphite, boron, polypropylene or polyethylene.

6. The article of clothing of claim 1, wherein the low coefficient of friction material includes polytetrafluoroethylene or homopolymers and copolymers thereof.

7. The article of clothing of claim 6, wherein polytetrafluoroethylene is a fiber or yarn.

8. The article of clothing of claim 1, wherein the coefficient of friction of the outer surface of the article is less than 0.6.

9. The article of clothing of claim 1, wherein the article of clothing is sports apparel.

10. The article of clothing of claim 9, wherein the sports apparel is a football, baseball, basketball, wrestling, soccer, hockey, handball, skiing, biking, skating, sky-diving, snow boarding or hunting uniform.

11. The article of clothing of claim 9, wherein the sports apparel is a sport protection apparel.

12. The article of clothing of claim 11, wherein the sport protection apparel is a knee pad, elbow pad, wrist pad or head gear.

13. The article of clothing of claim 9, wherein the article of clothing is apparel used in water sports.

14. The article of clothing of claim 13, wherein the article of clothing is used for swimming.

15. The article of clothing of claim 13, wherein the apparel is a swimsuit, wet suit or sailing suit.

16. The article of clothing of claim 9, wherein the article of clothing is used for running.

17. The article of clothing of claim 9, wherein the low coefficient of friction material incorporated into the sports apparel is polytetrafluoroethylene yarn or fiber.

18. The article of clothing of claim 1, wherein the external environment is air, water, ice, snow, dirt, grass or solid surfaces.

19. The article of clothing of claim 1, wherein the non-temporary low coefficient of friction material includes low friction chemicals applied directly to a finished fibers to impart low friction properties.

20. The article of clothing of claim 1, wherein the article of clothing is a shoe, boot or sneaker.

21. The article of clothing of claim 1, wherein the article of clothing is winter apparel.

22. A method for producing an article of clothing which is adapted to be worn by a user wherein frictional contact between an outer surface of the article and an external environment is reduced, comprising the step of weaving and/or knitting into the article of clothing fibers having a low coefficient of friction characteristic such that a low coefficient of friction characteristic is imparted to the outer surface of the article.

23. The method of claim 22, wherein the coefficient of friction of the outer surface of the article incorporating the low coefficient of friction material is less than about 80% of the coefficient of friction of the outer surface of the article not incorporating the low coefficient of friction material.

24. The method of claim 22, wherein the coefficient of friction of the outer surface of the article incorporating the low coefficient of friction material is less than about 60% of the coefficient of friction of the outer surface of the article not incorporating the low coefficient of friction material.

25. The method of claim 22, wherein the coefficient of friction of the outer surface of the article incorporating the low coefficient of friction material is less than about 50% of the coefficient of friction of the outer surface of the article not incorporating the low coefficient of friction material.

26. The method of claim 22, wherein the low coefficient of friction material includes silicone, silicone copolymers, silicone elastomers, polytetrafluoroethylene or homopolymers and copolymers thereof, graphite, boron, polypropylene or polyethylene.

27. The method of claim 22, wherein the low coefficient of friction material includes polytetrafluoroethylene or homopolymers and copolymers thereof.

28. The method of claim 27, wherein polytetrafluoroethylene is a fiber or yarn.

29. The method of claim 22, wherein the coefficient of friction of the outer surface of the article is less than 0.6.

30. The method of claim 22, wherein the article of clothing is sports apparel.

31. The method of claim 30, wherein the sports apparel is a football, baseball, basketball, wrestling, soccer, hockey, handball, skiing, biking, skating, sky-diving, snow boarding or hunting uniform.

32. The method of claim 30, wherein the sports apparel is a sport protection apparel.

33. The method of claim 32, wherein the sport protection apparel is a knee pad, elbow pad, wrist pad or head gear.

34. The method of claim 30, wherein the article of clothing is apparel used in water sports.

35. The method of claim 34, wherein the article of clothing is used for swimming.

36. The method of claim 34, wherein the apparel is a swimsuit, wet suit or sailing suit.

37. The method of claim 30, wherein the article of clothing is used for running.

38. The method of claim 30, wherein the low coefficient of friction material incorporated into the sports apparel is polytetrafluoroethylene yarn or fiber.

39. The method of claim 22, wherein the external environment is air, water, ice, snow, dirt, grass or solid surfaces.

40. The method of claim 22, wherein the non-temporary low coefficient of friction material includes low friction chemicals applied directly to finished fibers to impart low friction properties.

41. The method of claim 22, wherein the article of clothing is a shoe, boot or sneaker.

42. The method of claim 22, wherein the article of clothing is winter apparel.

43. The article of clothing used for swimming as recited in claim 14, wherein the low coefficient of friction material is incorporated into only selected areas of said article.

44. The method of claim 35, wherein the low coefficient of friction material is incorporated into only selected areas of said article.

45. The article of clothing used for swimming as recited in claim 1, wherein the external environment is water.

46. The method of claim 22, wherein the external environment is water.

47. The article of clothing used for swimming as recited in claim 1, wherein the external environment is air.

48. The method of claim 22, wherein the external environment is air.

49. The article of clothing as recited in claim 1, wherein said low coefficient of friction material is incorporated into the article by weaving said fibers having a low coefficient of friction characteristic into a fabric and then sewing said fabric into the article.

50. The method as recited in claim 22, wherein said low coefficient of friction material is incorporated into the article by weaving said fibers having a low coefficient of friction characteristic into a fabric and then sewing said fabric into the article.

* * * * *